US010987819B2

(12) United States Patent
Huai

(10) Patent No.: US 10,987,819 B2
(45) Date of Patent: Apr. 27, 2021

(54) GRILLE FOR HAIR SHAVER

(71) Applicant: HAINING XINYI MACHINERY ELECTRICAL CO., LTD., Haining (CN)

(72) Inventor: Huapei Huai, Jiaxing (CN)

(73) Assignee: Haining Xinyi Machinery Electrical Co., Ltd., Jianxing (CN)

( * ) Notice: Subject to any disclaimer, the term of this patent is extended or adjusted under 35 U.S.C. 154(b) by 0 days.

(21) Appl. No.: 16/417,964

(22) Filed: May 21, 2019

(65) Prior Publication Data

US 2019/0366568 A1 Dec. 5, 2019

(30) Foreign Application Priority Data

Jun. 1, 2018 (CN) ..... 201810557562.4
Jun. 1, 2018 (CN) ..... 201820851177.6

(51) Int. Cl.
*B26B 19/38* (2006.01)
*B26B 19/14* (2006.01)

(52) U.S. Cl.
CPC ..... *B26B 19/384* (2013.01); *B26B 19/14* (2013.01); *B26B 19/143* (2013.01)

(58) Field of Classification Search
CPC ..... B26B 19/384; B26B 19/14; B26B 19/00; B26B 19/143; B26B 19/04; B26B 19/3846
See application file for complete search history.

(56) References Cited

U.S. PATENT DOCUMENTS 2,365,368 A * 12/1944 Verschuyl ..... B26B 19/143 30/43.6
2,632,948 A * 3/1953 Konrad ..... B26B 19/14 30/43.6
2,824,367 A * 2/1958 McWilliams ..... B26B 19/143 30/41.5
3,116,551 A * 1/1964 Anton ..... B26B 19/143 30/43.6
4,056,992 A * 11/1977 Blume ..... B26B 19/384 76/104.1
4,393,586 A * 7/1983 Hamashima ..... B26B 19/143 30/346.51
4,630,370 A * 12/1986 Hamada ..... B26B 19/14 30/346.51
5,544,414 A * 8/1996 Dekker ..... B26B 19/14 30/346.51

(Continued)

*Primary Examiner* — Sean M Michalski
(74) *Attorney, Agent, or Firm* — Flener IP Law; Zareefa B. Flener

(57) ABSTRACT

An objective of the present invention is to provide a grille for a hair shaver. In the present invention, by the combination of V-shaped hair shaving slots (including hair shaving long slots and hair shaving short slots) formed on the support surfaces at preset intervals, while contacting with the skin by the support surfaces, the hair is distributed to the hair shaving long slots and the hair shaving short slots on two sides, so that the hair is easier to enter a hair shaving region without escaping against the support surfaces. Accordingly, without reducing the effective hair shaving area, it is convenient for long hair to enter a hair shaving part, and a larger effective hair shaving length is obtained; and meanwhile, an effective support is provided for the skin, and the skin is prevented from being scratched by a blade.

8 Claims, 3 Drawing Sheets

(56) References Cited

U.S. PATENT DOCUMENTS

| | | | | |
|---|---|---|---|---|
| 5,625,950 | A * | 5/1997 | Sterk | B26B 19/145 30/346.51 |
| 5,802,932 | A * | 9/1998 | Vankov | B26B 19/042 76/104.1 |
| 5,857,260 | A * | 1/1999 | Yamada | B26B 19/384 30/346.51 |
| 6,085,421 | A * | 7/2000 | Jorna | B26B 19/143 30/346.51 |
| 9,555,551 | B2 * | 1/2017 | Campbell | B26B 19/143 |
| 9,821,478 | B2 * | 11/2017 | Kleine Doepke | B26B 19/384 |
| 2003/0070304 | A1 * | 4/2003 | Curello | B26B 19/14 30/346.51 |
| 2006/0042100 | A1 * | 3/2006 | Everett, Jr. | B26B 19/14 30/346.51 |
| 2007/0079510 | A1 * | 4/2007 | Hannan | B26B 19/14 30/43.6 |
| 2008/0040927 | A1 * | 2/2008 | Lau | B26B 19/26 30/34.1 |
| 2008/0216320 | A1 * | 9/2008 | Royle | B26B 19/14 30/34.1 |
| 2009/0071009 | A1 * | 3/2009 | Hamburg | B26B 19/42 30/41.6 |
| 2010/0139098 | A1 * | 6/2010 | Kuijper | B26B 19/143 30/45 |
| 2012/0055026 | A1 * | 3/2012 | Pohl | B26B 19/14 30/43.6 |

* cited by examiner

GRILLE FOR HAIR SHAVER

TECHNICAL FIELD OF THE INVENTION

The present invention relates to a grille for a hair shaver.

BACKGROUND OF THE INVENTION

For hair shavers, particularly rotary hair shavers, the hair is allowed to enter a particular region of a grille by providing hair inlet slots and hair inlet holes, and the hair is then shaved by coordination of the grille with blades. However, conventional narrow hair inlet slots are disadvantageous for the entrance of long hair. Although the long hair can be allowed to enter smoothly by increasing the width of the hair inlet slots, the skin cannot be effectively supported, so that the skin is easy to enter the hair inlet slots, resulting in a risk of scratching the skin.

SUMMARY OF THE INVENTION

An objective of the present invention is to provide a grille for a hair shaver.

According to one aspect of the present invention, a grille for a hair shaver is provided, including:

first support surfaces; and

V-shaped hair shaving slots formed on the support surfaces at preset intervals, wherein the V-shaped hair shaving slots include hair shaving long slots and hair shaving short slots, one end of each of the hair shaving long slots is connected to one end of one of the hair shaving short slots to form a V shape, and the length of each of the hair shaving long slots is greater than that of each of the hair shaving short slots.

Further, in the grille for a hair shaver, both the hair shaving long slots and the hair shaving short slots are covered by the annular width of a blade in their lower portions.

Further, in the grille for a hair shaver, a V-shaped bent section is provided at the other end of each of the hair shaving short slots.

Further, in the grille for a hair shaver, an included angle of the V-shaped bent section at the other end of each of the hair shaving short slots has various angles.

Further, in the grille for a hair shaver, the first support surfaces are annular.

Further, in the grille for a hair shaver, there is a plurality of first support surfaces.

Further, the grille for a hair shaver further includes second support surfaces, with the second support surfaces being annular and arranged concentrically to or adjacent to the first support surfaces.

Further, in the grille for a hair shaver, there is a plurality of second support surfaces.

Further, rectangular hair shaving slots are formed on the second support surfaces at preset intervals, and the length of each of the rectangular hair shaving slots is 5 to 7 times of the width thereof.

Further, in the grille for a hair shaver, the rectangular hair shaving slots are covered by the annular width of a blade in their lower portions.

Compared with the prior art, in the present invention, by the combination of V-shaped hair shaving slots (including hair shaving long slots and hair shaving short slots) formed on the support surfaces at preset intervals, while contacting with the skin by the support surfaces, the hair is distributed to the hair shaving long slots and the hair shaving short slots on two sides, so that the hair is easier to enter a hair shaving region without escaping against the support surfaces. Accordingly, without reducing the effective hair shaving area, it is convenient for long hair to enter a hair shaving part, and a larger effective hair shaving length is obtained; and meanwhile, an effective support is provided for the skin, and the skin is prevented from being scratched by a blade.

BRIEF DESCRIPTION OF THE DRAWINGS

Other features, objectives and advantages of the present invention will become apparent by reading the detailed description of non-limiting embodiments with reference to the following accompanying drawings, in which.

Throughout the accompanying drawings, identical or similar reference numerals represent identical or similar components.

DETAILED DESCRIPTION OF THE INVENTION

The present invention will be further described below in detail with reference to the accompanying drawings.

Figure 1:
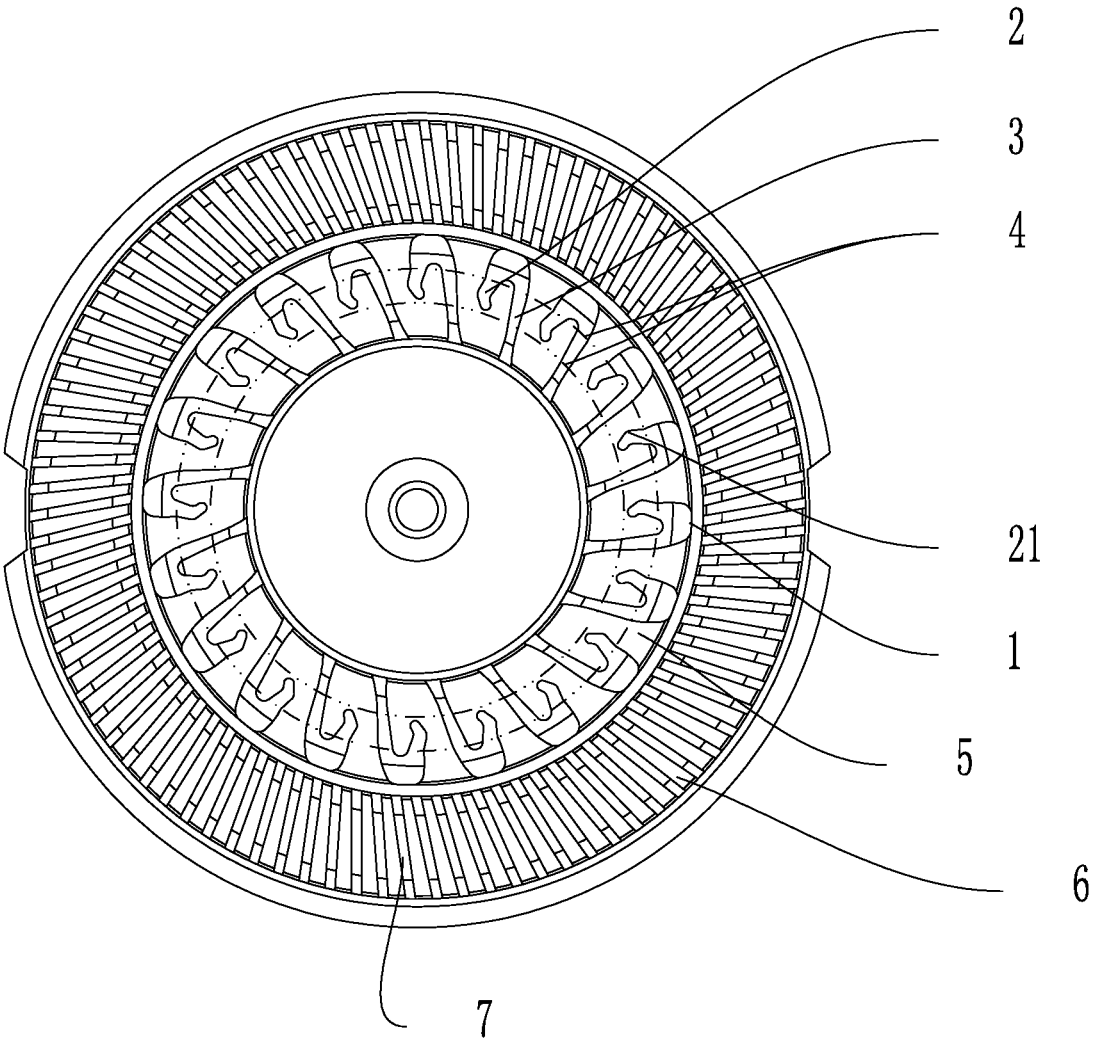
FIG. 1 shows a schematic diagram of a grille for a hair shaver according to an embodiment of the present invention.

As shown in FIG. 1, the present invention provides a grille for a hair shaver, including:

first support surfaces 5;

V-shaped hair shaving slots 1 formed on the support surfaces at preset intervals, wherein the V-shaped hair shaving slots include hair shaving long slots 3 and hair shaving short slots 2, one end of each of the hair shaving long slots 3 is connected to one end of one of the hair shaving short slots 2 to form a V shape, and the length of each of the hair shaving long slots 3 is greater than that of each of the hair shaving short slots 2.

Here, the length of each of the hair shaving short slots 2 may be two fifths to two thirds of the length of each of the hair shaving long slots 3.

In the present invention, by the combination of V-shaped hair shaving slots (including hair shaving long slots and hair shaving short slots) formed on the support surfaces at preset intervals, while contacting with the skin by the support surfaces, the hair is distributed to the hair shaving long slots and the hair shaving short slots on two sides, so that the hair is easier to enter a hair shaving region without escaping against the support surfaces. Accordingly, without reducing the effective hair shaving area, it is convenient for long hair to enter a hair shaving part, and a larger effective hair shaving length is obtained; and meanwhile, an effective support is provided for the skin, and the skin is prevented from being scratched by a blade.

Figure 2:
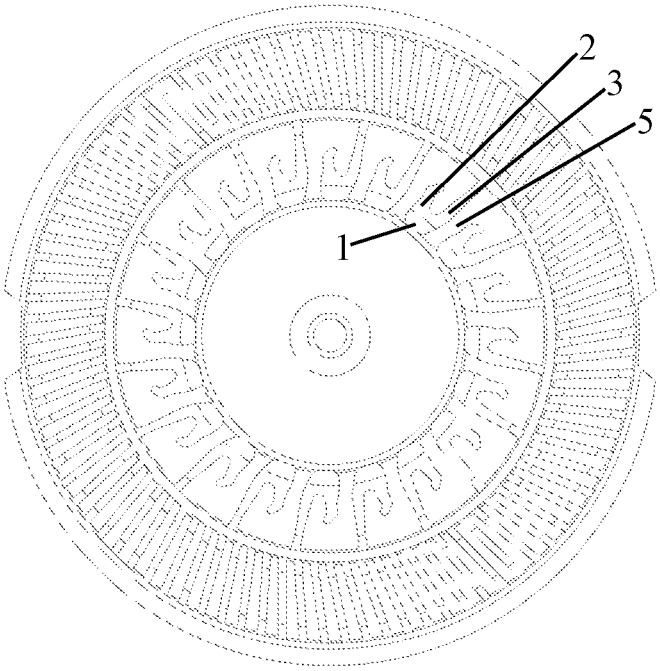
FIG. 2 shows a schematic diagram of a grille for a hair shaver according to another embodiment of the present invention.

In addition, as shown in FIG. 1, the openings of the V-shaped hair shaving slots may face a center of the grille for a hair shaver, or as shown in FIG. 2, the openings of the V-shaped hair shavings slots may oppose to the center of the grille for a hair shaver.

Figure 3:
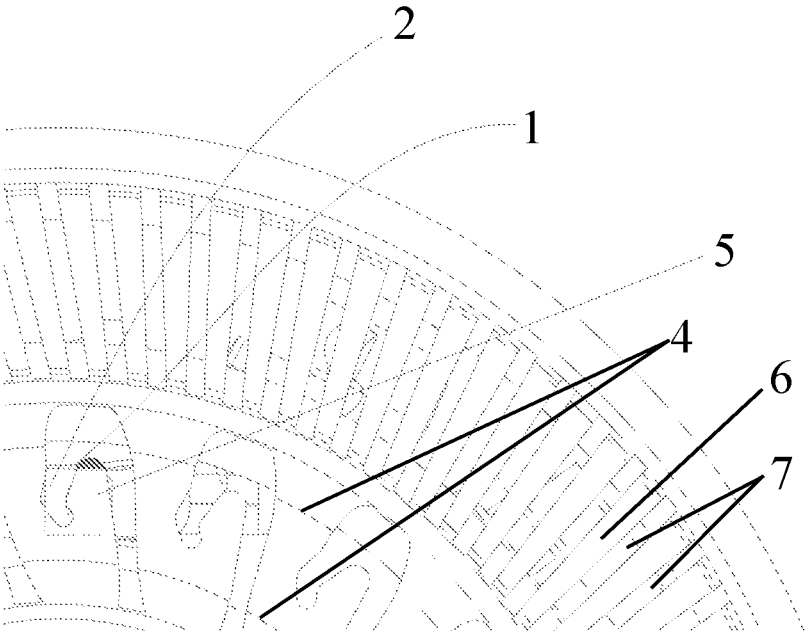
FIG. 3 shows a schematic diagram of coordination of the grille for a hair shaver with a blade according to an embodiment of the present invention.
Figure 4:
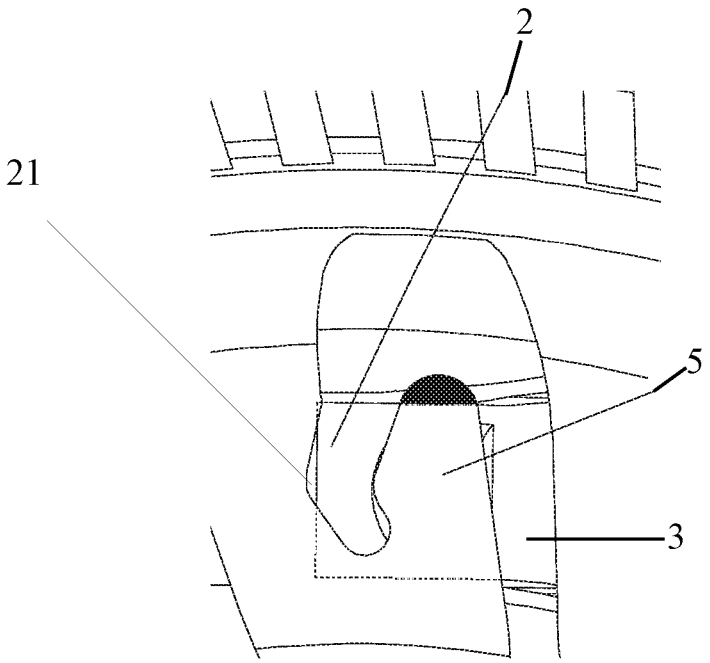
FIG. 4 shows an enlarged view of FIG. 3.

As shown in FIGS. 3 and 4, in an embodiment of the grille for a hair shaver of the present invention, both the hair shaving long slots 3 and the hair shaving short slots 2 are covered by the annular width of a blade 4 in their lower portions (the dashed region in FIGS. 3 and 4).

Here, the V-shaped hair shaving slots in the present invention can be covered by cutting edges of blades, so it is ensured that the hair entering the hair shaving long slots 3 and the hair shaving short slots 2 is shaved and the efficient and reliable hair shaving is realized.

As shown in FIGS. 1 and 4, in an embodiment of the grille for a hair shaver of the present invention, a V-shaped bent section 21 is provided at the other end of each of the hair shaving short slots 2.

Here, if the hair entering the hair shaving long slots 3 is not shaved by blades in their lower portions, the hair will slip out of the hair shaving long slots. However, once the hair enters the hair shaving short slots 2, the V-shaped bent section 21 provided at the other end of each of the hair shaving short slots 2 can assist in securing the hair and prevent the hair from escaping. Accordingly, it is ensured that the hair entering the hair shaving short slots 2 is shaved, and the user's discomfort caused by pulling the hair is avoided.

In an embodiment of the grille for a hair shaver of the present invention, an included angle of the V-shaped bent section 21 at the other end of each of the hair shaving short slots 2 has various angles.

Here, the V-shaped bent section may be arranged at various shear angles in order to adapt to different angles of hair.

As shown in FIG. 1, in an embodiment of the grille for a hair shaver of the present invention, the first support surfaces 5 are annular, and the V-shaped hair shaving slots 1 are formed on the first annular support surfaces 5 at preset intervals.

Here, by designing the first support surfaces 5 to be annular, the V-shaped hair shaving slots on the annular support surfaces may be arranged more uniformly, and the hair shaving effect is thus improved.

In an embodiment of the grille for a hair shaver of the present invention, there is a plurality of first support surfaces 5.

Here, by providing a plurality of first annular support surfaces 5, the V-shaped hair shaving slots can be arranged on each of the first support surfaces 5, and the hair shaving effect can be further improved.

As shown, in an embodiment of the grille for a hair shaver of the embodiment, the grille for a hair shave further includes second support surfaces 6, with the second support surfaces 6 being annular and arranged concentrically to or adjacent to the first support surfaces 5.

Here, by providing the second support surfaces, a more effective support can be provided for the skin, and the skin is prevented from being scratched by a blade. In addition, it is possible to form the V-shaped hair shaving slots or hair shaving slots in other shapes on the second support surfaces, so that the hair shaving effect is further improved.

Figure 5:
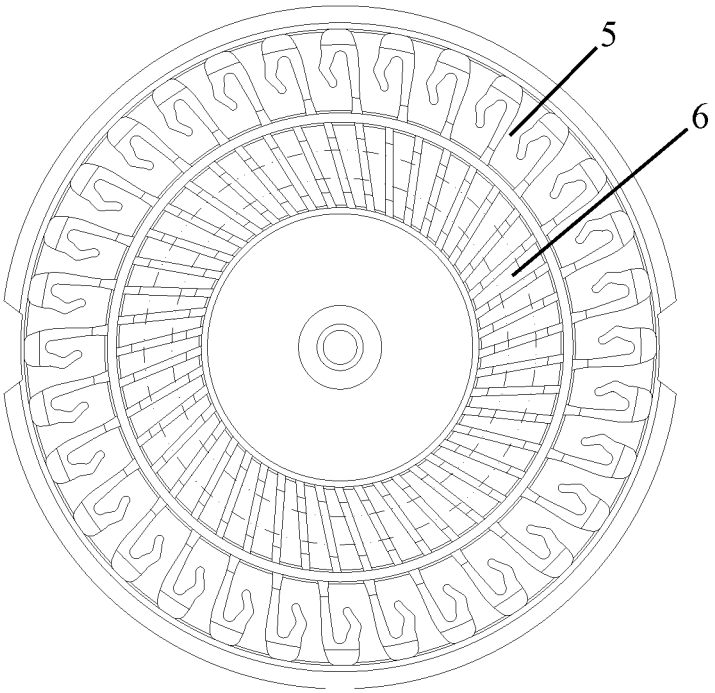
FIG. 5 shows a schematic diagram of a grille for a hair shaver according to still another embodiment of the present invention.

As shown in FIG. 1, the first support surfaces 5 may be arranged in an inner ring and the second support surfaces 6 may be arranged in an outer ring; or, as shown in FIG. 5, the first support surfaces 5 may be arranged in an outer ring and the second support surfaces 6 may be arranged in an inner ring.

In an embodiment of the grille for a hair shaver of the present invention, there is a plurality of second support surfaces 6.

Here, by providing a plurality of second annular support surfaces, the V-shaped hair shaving slots or hair shaving slots in other shapes can be arranged on each of the second annular support surfaces, and the hair shaving effect can be further improved.

As shown in FIG. 1, in an embodiment of the grille for a hair shaver of the present invention, rectangular hair shaving slots 7 are formed on the second support surfaces 6 at preset intervals, and the length of each of the rectangular hair shaving slots 7 is 5 to 7 times of the width thereof, so that it is ensured that longer hair can enter the rectangular hair shaving slots.

In an embodiment of the grille for a hair shaver of the present invention, the rectangular hair shaving slots are covered by the annular width of a blade in their lower portions, so that it is ensured that the hair entering the rectangular hair shaving slots is reliably shaved.

Apparently, those skilled in the art can make various modifications and transformations to the present application without departing from the spirit and scope of the present application. Thus, if these modifications and transformations to the present application fall into the scope of the appended claims of the present invention and equivalent techniques thereof, the present application is also intended to include these modifications and transformations.

It is apparent for those skilled in the art that the present invention is not limited to the details of the foregoing exemplary embodiments and the present invention can be implemented in other specific forms without departing from the spirit or essential features of the present invention. Therefore, the embodiments should be regarded as being exemplary and non-limiting in any respect, and the scope of the present invention shall be defined by the appended claims rather than the foregoing descriptions. Hence, all variations falling into the meaning and scope of the equivalent elements of the claims shall be incorporated into the present invention. In addition, it is apparent that the term "comprise/comprising" does not exclude the presence of other units or steps and the singular form does not exclude the plural form. A plurality of units or devices stated in the device claims may also be realized by one unit or device through software or hardware. The terms such as first or second are used for representing names, rather than representing any particular order.

The invention claimed is:

1. A grille for a hair shaver, comprising:

a first annular configuration of first support surfaces;

hair shaving long slots formed between the first support surfaces at first preset intervals, and hair shaving short slots formed between the first support surfaces at the first preset intervals, wherein each of the hair shaving long slots spans the first annular configuration from an inner radius thereof to an outer radius thereof, and a first end of each of the hair shaving long slots is connected to a first end of each of the hair shaving short slots.

2. A combination of a grille and shaving blades, comprising the grille for a hair shaver according to claim 1, and further comprising:

cutting blades disposed under the first annular configuration of first support surfaces, wherein the cutting blades are configured to cut hair that extends through both the hair shaving long slots and the hair shaving short slots.

3. The grille for a hair shaver according to claim 1, wherein a second end of each hair shaving short slot includes a section that is bent relative to the rest of the hair shaving short slot.

4. The grille for a hair shaver according to claim 1, wherein there is a plurality of the first support surfaces.

5. The grille for a hair shaver according to claim 1, further comprising a second annular configuration of second support surfaces, wherein the second annular configuration of second support surfaces is concentric with the first annular configuration of first support surfaces.

6. The grille for a hair shaver according to claim 5, wherein there is a plurality of the second support surfaces.

7. The grille for a hair shaver according to claim 5, wherein rectangular hair shaving slots are formed between the second support surfaces at second preset intervals, and the length of each of the rectangular hair shaving slots is 5 to 7 times of the width thereof.

8. A combination of a grille and shaving blades, comprising the grille for a hair shaver according to claim 7, and further comprising:

cutting blades disposed under the second annular configuration of second support surfaces, wherein the cutting blades are configured to cut hair that extends through the rectangular hair shaving slots.

* * * * *